US008919773B2

(12) United States Patent
Kato

(10) Patent No.: US 8,919,773 B2
(45) Date of Patent: Dec. 30, 2014

(54) SHEET CONVEYOR AND IMAGE FORMING APPARATUS INCORPORATING SAME

(71) Applicant: Shinichi Kato, Tokyo (JP)

(72) Inventor: Shinichi Kato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/945,992

(22) Filed: Jul. 19, 2013

(65) Prior Publication Data

US 2014/0035223 A1 Feb. 6, 2014

(30) Foreign Application Priority Data

Jul. 31, 2012 (JP) ..... 2012-169764
Jan. 18, 2013 (JP) ..... 2013-007581

(51) Int. Cl.
*B65H 29/58* (2006.01)
*B65H 85/00* (2006.01)
*B65H 15/00* (2006.01)

(52) U.S. Cl.
CPC ..... *B65H 85/00* (2013.01); *B65H 15/00* (2013.01); *B65H 29/58* (2013.01); *B65H 2404/63* (2013.01); *B65H 2301/33312* (2013.01)
USPC ..... 271/303; 271/301; 271/225; 271/186; 271/291

(58) Field of Classification Search
CPC ..... B65H 29/58; B65H 29/60; B65H 85/00; B65H 2404/63; B65H 2301/33312
USPC ..... 271/291, 186, 303, 301, 225; 399/401, 399/364, 374
See application file for complete search history.

(56) References Cited

U.S. PATENT DOCUMENTS

| | | | | |
|---|---|---|---|---|
| 7,918,451 | B2 * | 4/2011 | Honda et al. | 271/225 |
| 2010/0192710 | A9 * | 8/2010 | Hanashima et al. | 74/55 |
| 2013/0020753 | A1 * | 1/2013 | Ito | 271/10.13 |
| 2013/0106050 | A1 * | 5/2013 | Nishii et al. | 271/225 |
| 2013/0181397 | A1 * | 7/2013 | Nunn et al. | 271/303 |

FOREIGN PATENT DOCUMENTS

| | | | |
|---|---|---|---|
| JP | 05040374 A | * | 2/1993 |
| JP | 2011-144050 | | 7/2011 |

* cited by examiner

*Primary Examiner* — Luis A Gonzalez
(74) *Attorney, Agent, or Firm* — Harness, Dickey & Pierce, P.L.C.

(57) ABSTRACT

A sheet conveyor included in an image forming apparatus includes a conveying roller rotatable in normal and reverse directions to convey a sheet in opposite sheet conveyance directions, a switching guide rotatable about a support shaft to guide the sheet to a path, a first switchback mechanism performing a first operation of changing a direction of rotation of the conveying roller, a first actuator actuating the first switchback mechanism, a second switchback mechanism performing a second operation of changing a position of the switching guide, a second actuator actuating the second switchback mechanism. The switchback mechanisms and the actuators are configured to be replaceable with a switchback linking mechanism, by employing a linking member, configured to link the first and second operations to be actuated by one actuator of the first and second actuators without changing an arrangement of the one actuator of the first and second actuators.

17 Claims, 3 Drawing Sheets

SHEET CONVEYOR AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2012-169764, filed on Jul. 31, 2012 and 2013-007581, filed on Jan. 18, 2013 in the Japan Patent Office, the entire disclosures of which are hereby incorporated by reference herein.

BACKGROUND

1. Technical Field

Embodiments of the present invention relates to a sheet conveyor for conveying a sheet of recording material and an image forming apparatus incorporating the sheet conveyor.

2. Related Art

For duplex printing, image forming apparatuses typically rotate a sheet discharging roller in reverse before a sheet discharging portion to change a direction of rotation of the sheet discharging roller to switch back the sheet and switch the position of a separator disposed near the sheet discharging roller to change a direction of sheet path to guide the sheet of recording material to a duplex printing path.

Japanese Patent Application Publication No. JP-2011-144050-A discloses a sheet conveyor having a switchback mechanism in which an action to change a direction of rotation of a sheet conveying roller (i.e., a sheet discharging roller) and another action to change a position of a switching member (i.e., a branch guide) are linked by a linking member and operated by a solenoid actuator.

This sheet conveyor having one solenoid actuator for performing two actions reduces costs by comparing with a sheet conveyor having two solenoid actuators for performing two respective actions differently.

By contrast, the related-art sheet conveyor is configured to synchronize two actions with one solenoid actuator. Therefore, by comparing with the sheet conveyor with two solenoid actuators, the related-art sheet conveyor has restrictions on switchback timing, which decreases productivity of image forming apparatuses.

Some users set a higher value on high productivity than low cost and some do on low cost than high productivity. Therefore, manufacturers may develop and produce various types of image forming apparatuses having different configurations to meet the demands of both users. Producing such different types of image forming apparatuses without a common sheet conveyor significantly degrade development and production efficiencies.

SUMMARY

The present invention provides a sheet conveyor including a conveying roller rotatable in normal and reverse directions to convey a sheet of recording material in opposite sheet conveyance directions, a support shaft, a switching guide rotatable about the support shaft to guide the sheet to a selected conveyance path, a first switchback mechanism configured to perform a first operation of changing a direction of rotation of the conveying roller, a first actuator to actuate the first switchback mechanism to perform the first operation, a second switchback mechanism configured to perform a second operation of changing a position of the switching guide, and a second actuator to actuate the second switchback mechanism to perform the second operation. The first switchback mechanism and the second switchback mechanism are replaceable with a switchback linking mechanism by employing a linking member and the switchback linking mechanism is configured to link the first operation and the second operation to be actuated by one actuator of the first actuator and the second actuator without changing an arrangement of the one actuator of the first actuator and the second actuator.

Further, the present invention provides an image forming apparatus, which includes the above-described sheet conveyor, including an image forming device, and the above-described sheet conveyor.

Further, the present invention provides a sheet conveyor including a conveying roller rotatable in normal and reverse directions to convey a sheet of recording material in opposite sheet conveyance directions, a support shaft, a switching guide rotatable about the support shaft to guide the sheet to a selected conveyance path, a switchback linking mechanism including a linking member and configured to link the first operation and the second operation, and a first actuator to actuate the switchback linking mechanism. The linking member is removed from the switchback linking mechanism to replace the switchback linking mechanism with a first switchback mechanism to perform the first operation and a second switchback mechanism to perform the second operation to cause the first operation and the second operation to be performed separately. A second actuator is employed, so that the first switchback mechanism is actuated by the first actuator and the second switchback mechanism is actuated by the second actuator.

Further, the present invention provides an image forming apparatus, which includes the above-described sheet conveyor, including an image forming device, and the above-described sheet conveyor.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
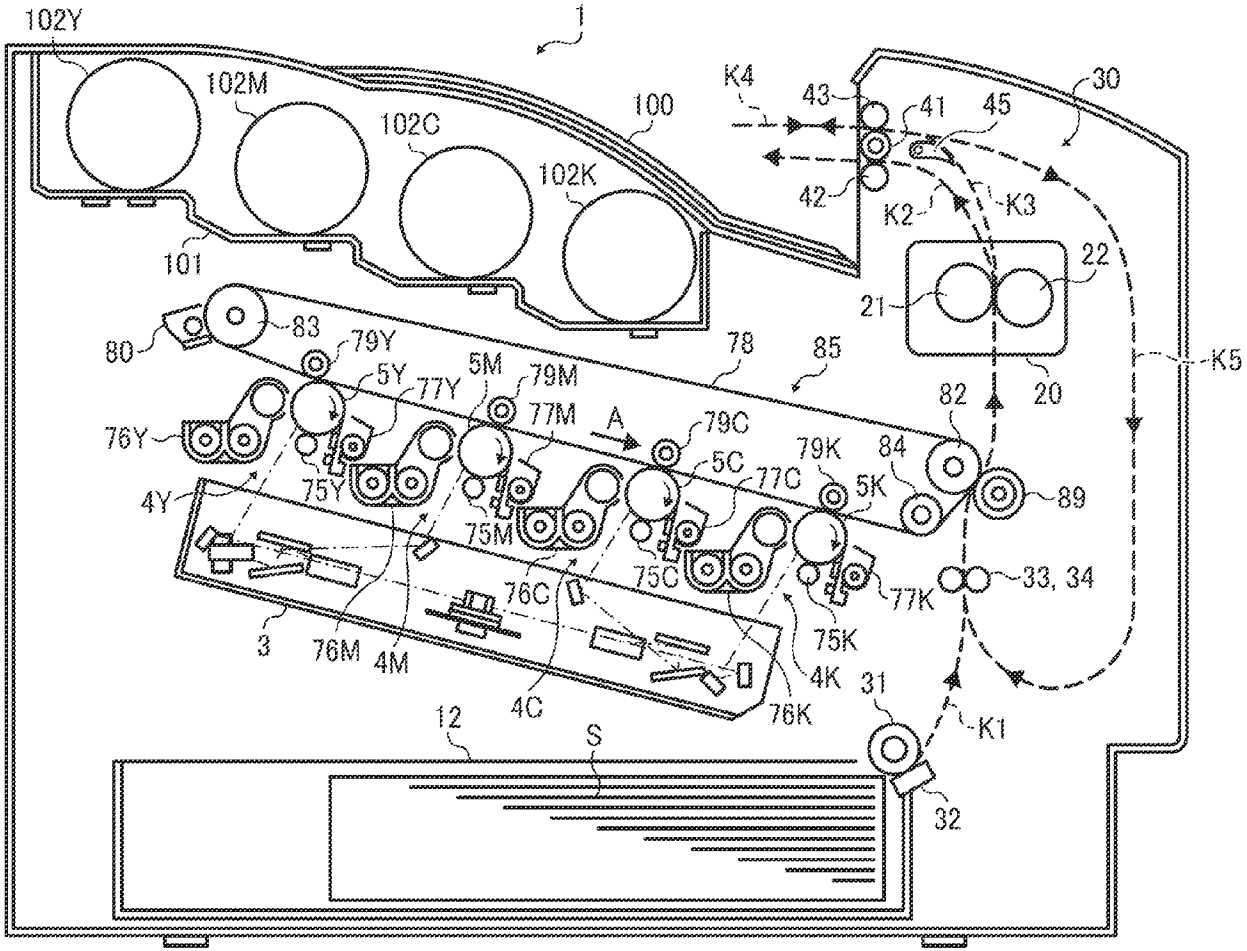
FIG. 1 is a diagram illustrating an overall configuration of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of configuration and operations of an image forming apparatus 1 according to an embodiment of the present invention, with reference to FIG. 1.

As illustrated in FIG. 1, the image forming apparatus 1 according to the present embodiment may be a copier, a facsimile machine, a printer, a multifunction printer having at least one of copying, printing, scanning, plotter, and facsimile functions, or the like. The image forming apparatus 1 may form an image by an electrophotographic method, an inkjet method, and/or the like. According to this embodiment, the image forming apparatus 1 functions as a tandem-type color printer for forming a color image on a recording medium by the electrophotographic method.

The image forming apparatus 1 includes a bottle container 101, an intermediate transfer unit 85, four image forming devices 4Y, 4M, 4C, and 4K, a sheet container 12, an exposure device 3, a fixing unit 20, and a sheet conveyor 30.

The bottle container 101 is disposed at an upper portion of the image forming apparatus 1 and includes four detachable and replaceable toner bottles 102Y, 102M, 102C, and 102K that correspond to yellow, magenta, cyan, and black toners, respectively.

The intermediate transfer unit 85 is disposed below the bottle container 101 and includes an intermediate transfer belt 78 that forms an endless loop.

The image forming devices 4Y, 4M, 4C, and 4K are aligned along the intermediate transfer belt 78 of the intermediate transfer unit 85, in contact with an outer circumference of a lower part of the intermediate transfer belt 78. The image forming devices 4Y, 4M, 4C, and 4K develop yellow, magenta, cyan, and black toner images, respectively.

The sheet container 12 is disposed at a lower portion of the image forming apparatus 1 and functions as a sheet tray that contains a stack of sheets including a sheet of recording material S onto which a toner image is transferred.

The sheet conveyor 30 is disposed at an upper right portion of the image forming apparatus 1 to discharge the sheet S toward a stacker 100 or switchback the sheet S toward a duplex printing conveyance path K5.

The image forming devices 4Y, 4M, 4C, and 4K include photoconductor drums 5Y, 5M, 5C, and 5K functioning as image carriers, respectively. Image forming units and components are disposed around each of the photoconductor drums 5Y, 5M, 5C, and 5K. The image forming units and components may be a charger 75 (i.e., chargers 75Y, 75M, 75C, and 75K), a development unit 76 (i.e., development units 76Y, 76M, 76C, and 76K), a cleaning unit 77 (i.e., cleaning units 77Y, 77M, 77C, and 77K), and a non-illustrated electric discharging unit. These units perform image forming processes such as a charging process, an exposing process, a developing process, a transferring process, and a cleaning process with respect to the photoconductor drums 5Y, 5M, 5C, and 5K for forming yellow, magenta, cyan, and black toner images, respectively.

In the charging process, the photoconductor drums 5Y, 5M, 5C, and 5K are driven by a driving motor for image forming (not illustrated) to rotate in clockwise in FIG. 1 and the surface thereof is uniformly charged at the chargers 75Y, 75M, 75C, and 75K. Then, in the exposing process, the surfaces of the photoconductor drums 5Y, 5M, 5C, and 5K pass an area where the exposure device 3 emits a laser light beam L to expose the surfaces of the photoconductor drums 5Y, 5M, 5C, and 5K so that respective electrostatic latent images for yellow, magenta, cyan, and black colors are formed thereon.

In the developing process, the surfaces of the photoconductor drums 5Y, 5M, 5C, and 5K then face the development units 76Y, 76M, 76C, and 76K, where the electrostatic latent images formed on the surfaces of the photoconductor drums 5Y, 5M, 5C, and 5K are developed into yellow, magenta, cyan, and black toner images.

The surfaces of the photoconductor drums 5Y, 5M, 5C, and 5K continue to rotate and face the intermediate transfer belt 78 and primary transfer bias rollers 79Y, 79M, 79C, and 79K, where the toner images formed on the surfaces of the photoconductor drums 5Y, 5M, 5C, and 5K are sequentially transferred onto the intermediate transfer belt 78 to form a composite toner image in the transferring process. Transfer of the toner images leave residual toner on the surfaces of the photoconductor drums 5Y, 5M, 5C, and 5K.

When the surfaces of the photoconductor drums 5Y, 5M, 5C, and 5K reach respective opposed positions to the cleaning units 77Y, 77M, 77C, and 77K, the residual toner remaining on the surfaces of the photoconductor drums 5Y, 5M, 5C, and 5K are mechanically removed and collected by respective cleaning blades of the cleaning units 77Y, 77M, 77C, and 77K in the cleaning process.

Finally, the surfaces of the photoconductor drums 5Y, 5M, 5C, and 5K face the respective electric discharging units so that residual electric charges are removed from the photoconductor drums 5Y, 5M, 5C, and 5K.

Thus, a series of image forming processes on the photoconductor drums 5Y, 5M, 5C, and 5K completes.

As described above, the composite toner image is formed on the intermediate transfer belt 78.

The intermediate transfer unit 85 includes the intermediate transfer belt 78, four primary transfer bias rollers 79Y, 79M, 79C, and 79K, a secondary transfer backup roller 82, a cleaning backup roller 83, a tension roller 84, an intermediate transfer cleaning unit 50, and so forth.

The intermediate transfer belt 78 is supported and stretched taut by the secondary transfer backup roller 82, the cleaning backup roller 83, and the tension roller 84 and endlessly rotated by the secondary transfer backup roller 82 connected to a non-illustrated drive motor in a direction indicated by arrow A in FIG. 1.

The four primary transfer bias rollers 79Y, 79M, 79C, and 79K face and contact the photoconductor drums 5Y, 5M, 5C, and 5K, respectively, interposing the intermediate transfer belt 78 therebetween, where respective primary transfer nip areas are formed. A transfer bias voltage that is opposite to a toner polarity is applied to the primary transfer bias rollers 79Y, 79M, 79C, and 79K.

As moving along the direction A, the intermediate transfer belt 78 sequentially passes the primary transfer nip areas of the primary transfer bias rollers 79Y, 79M, 79C, and 79K. Thus, toner images having different toner colors formed on the photoconductor drums 5Y, 5M, 5C, and 5K are primarily transferred sequentially onto the intermediate transfer belt 78.

Then, the intermediate transfer belt 78 on which the composite toner image is formed reaches an opposed position of a secondary transfer roller 89. At this position, the secondary transfer backup roller 82 faces and contacts the secondary transfer roller 89, interposing the intermediate transfer belt 78 therebetween, where respective a secondary transfer nip area is formed. The composite four-color toner image formed on the surface of the intermediate transfer belt 78 is transferred onto the sheet S that is conveyed to the secondary transfer nip area, in a secondary transfer process. Transfer of the composite toner image leaves residual toner on the surface of the intermediate transfer belt 78.

When the surface of the intermediate transfer belt 78 reaches an opposed position to the intermediate transfer cleaning unit 80, the residual toner remaining on the surface of the intermediate transfer belt 78 is removed and collected.

Thus, a series of transfer processes on the intermediate transfer belt 78 completes.

Here, the sheet S is conveyed from the sheet container 12 disposed at the lower portion of the image forming apparatus 1 to the secondary transfer nip area via a first sheet path K1.

Specifically, the sheet container 12 accommodates a stack of sheets S such as transfer sheets. Upon rotation of a feed roller 31 counterclockwise in FIG. 1, an uppermost sheet S held between the feed roller 31 and a friction pad 32 is guided by non-illustrated guide plates defining the first sheet path K1 toward registration rollers 33 and 34 functioning as a pair of timing rollers.

The uppermost sheet S conveyed to the registration rollers 33 and 34 is halted at a roller nip area formed between the registration rollers 33 and 34, the rotation of which remaining stopped. At the same timing as that the color toner image formed on the surface of the intermediate transfer belt 78 is transferred, the registration rollers 33 and 34 restart their rotation and the uppermost sheet S at the registration rollers 33 and 34 is then conveyed to the secondary transfer nip area (i.e., an image forming area), thereby transferring the desired color toner image onto the uppermost sheet S.

After having received the composite color toner image at the secondary transfer nip area, the uppermost sheet S is conveyed to the fixing unit 20, where the composite color toner image is fixed to the surface of the uppermost sheet S due to application of heat and pressure by a fixing belt 21 and a pressure roller 22.

Figure 2:
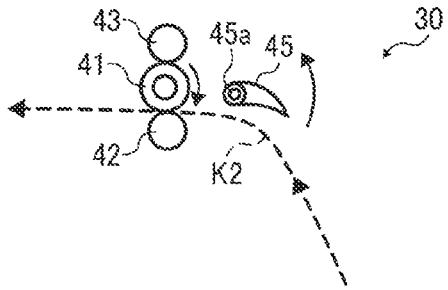
FIG. 2 is a schematic diagram illustrating a mechanism in a sheet conveyor for discharging a sheet of recording material to an outside of the image forming apparatus.

Now, FIG. 2 illustrates a mechanism in the sheet conveyor 30 for discharging the sheet S. The sheet conveyor 30 includes a sheet discharging drive roller 41, a first sheet discharging driven roller 42, a second sheet discharging driven roller 43, and a branch guide claw 45.

The sheet discharging drive roller 41 functions as a conveying roller capable of rotating selectively in normal and reverse directions to convey the sheet S in opposite directions by changing (switchback) a direction of rotation thereof.

The first sheet discharging driven roller 42 functions as a conveying roller biased to contact the sheet discharging drive roller 41 by a non-illustrated biasing member.

The second sheet discharging driven roller 43 also functions as a driven roller biased to contact the sheet discharging drive roller 41 by a non-illustrated biasing member.

The branch guide claw 45 functions as a switching guide to guide the sheet S to an appropriate conveyance path by changing (switchback) positions thereof by rotating to a given angle range about a support shaft 45*a* (i.e., a rotation axis) and stopping at a given position.

The uppermost sheet S after a fixing process is guided by the branch guide claw 45 into a discharging sheet conveyance path K2, as illustrated in FIG. 2. The discharging sheet conveyance path K2 is a second path defined by non-illustrated guide plates. Through the discharging sheet conveyance path K2, the uppermost sheet S is guided to a discharging nip area formed by the sheet discharging drive roller 41 and the first sheet discharging driven roller 42 to be discharged to the outside of the image forming apparatus 1 along with rotations of the sheet discharging drive roller 41 and the first sheet discharging driven roller 42. The following sheets S having fixed images thereon are output to the stacker 100 sequentially.

Thus, a series of image forming processes performed in the image forming apparatus 1 completes.

The above-described sheet conveying operations of the sheet S from the sheet container 12 to the stacker 100 in the image forming apparatus 1 are performed when a single side printing mode is selected for printing an image on one side (i.e., a front side) of the sheet S.

In the single side printing mode or when discharging the sheet S to the stacker 100 at completion of a duplex printing mode, the branch guide claw 45 rotates about a support shaft 45*a* (i.e., a rotation axis) counterclockwise within a given angle range and stops at a give position so that the discharging sheet conveyance path K2 is opened and a relay conveyance path K3 is closed, as illustrated in FIG. 2. The relay conveyance path K3 is a third path defined by non-illustrated guide plates. At this time, the sheet discharging drive roller 41 is rotated clockwise in FIG. 2 and the first sheet discharging driven roller 42 is rotated due to frictional resistance with the sheet discharging drive roller 41 counterclockwise in FIG. 2.

By contrast, when the duplex printing mode is selected for printing images on both sides (i.e., the front side and a back side) of the sheet S, the sheet S travelling in the image forming apparatus 1 operates as follows.

Figure 3A:
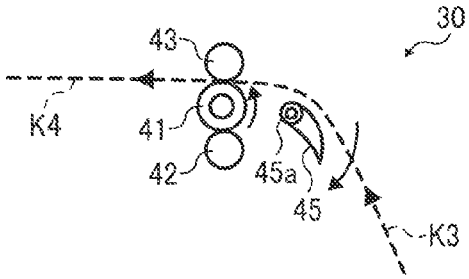
FIG. 3A is a schematic diagram illustrating operations of the sheet conveyor in duplex printing.

The sheet S travels from the sheet container 12 to the fixing unit 20 via the first sheet path K1 and the secondary transfer nip area in the same process taken when the single side printing mode is selected. After the fixing process, the sheet S with the fixed toner image formed on the front side thereof is conveyed in the relay conveyance path K3 to be guided by the branch guide claw 45 to enter into a switchback conveyance path K4, as illustrated in FIG. 3A. The switchback conveyance path K4 is a fourth path defined by non-illustrated guide plates. At this time, the branch guide claw 45 rotates about the support shaft 45*a* clockwise in a given angle range and stops at a given position so that the discharging sheet conveyance path K2 is closed and a relay conveyance path K3 is opened, as illustrated in FIG. 3A. Further, the sheet discharging drive roller 41 rotates counterclockwise in FIG. 3A and the second sheet discharging driven roller 43 is rotated due to frictional resistance with the sheet discharging drive roller 41 clockwise in FIG. 3A.

Figure 3B:
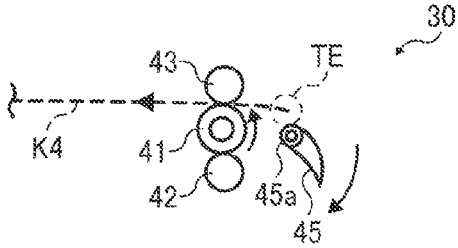
FIG. 3B is a schematic diagram illustrating operations of the sheet conveyor in duplex printing.

Then, as illustrated in FIG. 3B, when a trailing edge TE of the sheet S comes in the vicinity of a nip area formed by the sheet discharging drive roller 41 and the second sheet discharging driven roller 43 in the switchback conveyance path K4, i.e., when the trailing edge TE of the sheet S passes through the relay conveyance path K3, the sheet discharging drive roller 41 stops rotating.

Figure 3C:
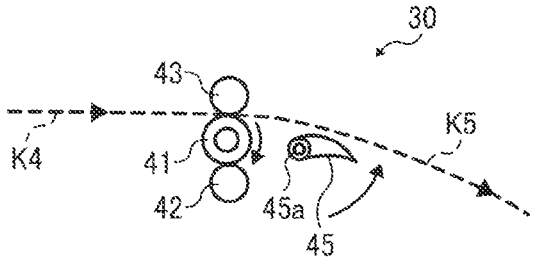
FIG. 3C is a schematic diagram illustrating operations of the sheet conveyor in duplex printing.

Then, as illustrated in FIG. 3C, the direction of conveyance of the sheet S is reversed to convey the sheet S toward the duplex printing conveyance path K5. At this time, the branch guide claw 45 rotates about the support shaft 45*a* counterclockwise within a given angle range and stops at the given position so that the relay conveyance path K3 is closed and the duplex printing conveyance path K5 is opened, as illustrated in FIG. 3C, which is the same position as shown in FIG. 2. Further, the sheet discharging drive roller 41 rotates clockwise in FIG. 3C and the second sheet discharging driven roller 43 is rotated due to frictional resistance with the sheet discharging drive roller 41 counterclockwise in FIG. 3C.

Thereafter, the sheet S guided to the duplex printing conveyance path K5 is conveyed by a not-illustrated multiple pairs of sheet conveying rollers provided in the duplex printing conveyance path K5 to the secondary transfer nip area, where a toner image for the back side is transferred onto the back side of the sheet S for the secondary transfer process. Then, the sheet S is conveyed to the fixing device 20, in which the toner image for the back side is fixed to the back side of the sheet S for the fixing process. These processes are the same as the secondary transfer process and the fixing process performed for the toner image for transferring and fixing to the front side of the sheet S.

After completion of printing the toner images on both sides of the sheet S, the sheet S is conveyed in the discharging sheet conveyance path K2, guided to the nip area formed between the sheet discharging drive roller 41 and the first sheet discharging driven roller 42, discharged to the outside of the image forming apparatus 1 along with rotations of the sheet discharging drive roller 41 and the first sheet discharging driven roller 42, and stacked sequentially on the stacker 100, as illustrated in FIG. 2.

Figure 4A:
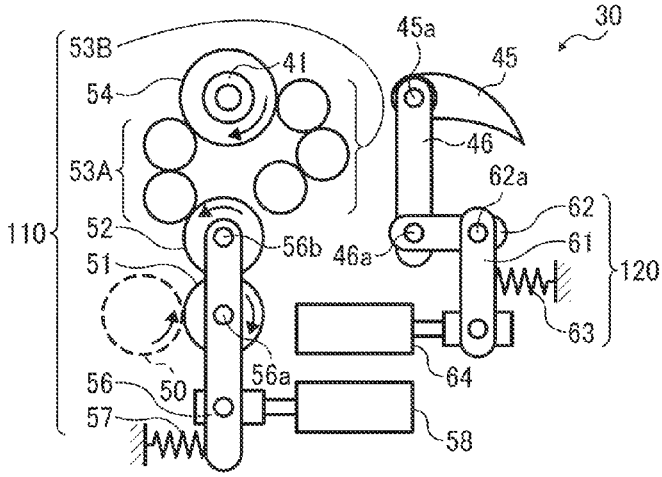
FIG. 4A is a diagram illustrating switchback mechanisms of the sheet conveyor in a first arrangement.
Figure 4B:
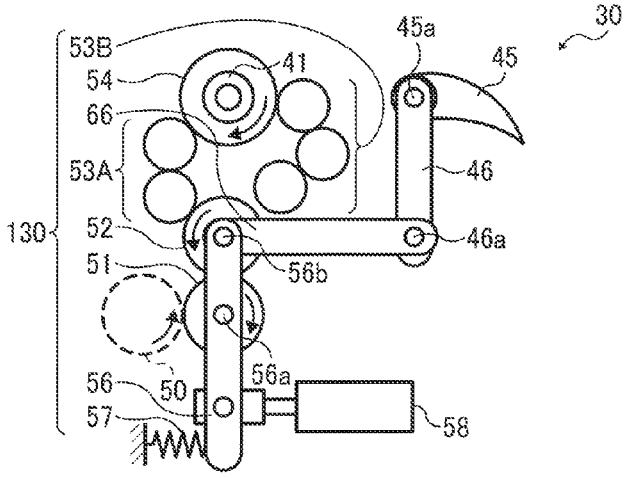
FIG. 4B is a diagram illustrating a switchback mechanism of the sheet conveyor in a second arrangement.

A description is given of detailed configuration and functions of the sheet conveyor 30 according to the present embodiment with reference to FIGS. 4A and 4B.

FIG. 4A is a schematic diagram illustrating a configuration of the sheet conveyor 30 in a first arrangement. FIG. 4B is a schematic diagram illustrating a configuration of the sheet conveyor 30 in a second arrangement.

As illustrated in FIGS. 1, 2, and 3A through 3C, the sheet conveyor 30 according to the present embodiment includes the sheet discharging drive roller 41 functioning as a sheet conveying roller to convey the sheet S by changing (switchback) the direction of rotation thereof, the branch guide claw 45 functioning as a switching guide to guide the sheet S to an appropriate path among the paths K2 through K5 by changing (switchback) positions by rotating about a support shaft 45*a* (i.e., a rotation axis) within a given angle range and stopping at the given position, and so forth.

The sheet conveyor 30 according to the present embodiment can change its configuration applicable to both the first arrangement as illustrated in FIG. 4A and the second arrangement as illustrated in FIG. 4B.

As illustrated in FIG. 4A, the sheet conveyor 30 in the first arrangement according to the present embodiment includes a first switchback mechanism 110 to change the direction of rotation of the sheet discharging drive roller 41 and a second switchback mechanism 120 to change the position of the branch guide claw 45. The first switchback mechanism 110 includes a first gear 51, a swing gear 52, a first relay gear train 53A, a second relay gear train 53B, a driving gear 54, a swing arm 56, and a tension spring 57 functioning as a biasing member. The first switchback mechanism 110 is provided with a first solenoid actuator 58 that actuate the first switchback mechanism 110. The second switchback mechanism 120 includes a first arm 61 and a second arm 62 functioning as a pair of transmission members, and a tension spring 63 functioning as a biasing member. The second switchback mechanism 120 is provided with a second solenoid actuator 64 that actuate the second switchback mechanism 120.

Further, as illustrated in FIG. 4B, the sheet conveyor 30 in the second arrangement according to the present invention includes a third switchback mechanism 130 that functions as a switchback linking mechanism to link a switchback operation performed by the first switchback mechanism 110 to change the direction of rotation of the sheet discharging drive roller 41 and a switchback operation performed by the second switchback to change the position of the branch guide claw 45 by adding a linking arm 66 functioning as a linking member. The third switchback mechanism 130 includes the first gear 51, the swing gear 52, the first relay gear train 53A, the second relay gear train 53B, the driving gear 54, the swing arm 56, the tension spring 57, and the linking arm 66. The third switchback mechanism 130 is provided with the first solenoid actuator 58.

As described above, the sheet conveyor 30 according to the present embodiment can change or switch its configuration between the first arrangement as illustrated in FIG. 4A and the second arrangement as illustrated in FIG. 4B.

In the present embodiment, the third switchback mechanism 130 is formed by the linking arm 66 and the units and components included in the first switchback mechanism 110 and the second switchback mechanism 120 except for the first arm 61, the second arm 62, and the tension spring 63. The second arrangement of the sheet conveyor 30 uses the first solenoid actuator 58 without the second solenoid actuator 64.

Specifically, in the first arrangement illustrated in FIG. 4A, the first solenoid actuator 58 actuates the first switchback mechanism 110 to change the direction of rotation of sheet discharging drive roller 41 and the second solenoid actuator 64 actuates the second switchback mechanism 120 to change (and stop at) the position of the branch guide claw 45.

As described above, the first switchback mechanism 110 illustrated in FIG. 4A includes the swing arm 56, the first gear 51, the swing gear 52, the tension spring 57 functioning as a biasing member, the first relay gear train 53A, the second relay gear train 53B, and the drive gear 54.

The first gear 51 is an idler gear that meshes with a second gear 50 that is a part of a driving system of the image forming apparatus 1.

The swing gear 52 is an idler gear meshed with the first gear 51.

The first relay gear train 53A and the second relay gear train 53B are gear trains including one or more idler gears and mesh with the drive gear 54.

The swing arm 56 includes a swing center shaft 56*a* to rotate thereabout and is rotatably supported in the sheet conveyor 30. The swing center shaft 56*a* is an axis to rotate the first gear 51. The swing arm 56 has one longitudinal end side to which the first solenoid actuator 58 is connected and an opposite end side to which the swing gear 52 is provided to rotate about a rotary center shaft 56*b*. One end of the tension spring 57 is connected to the edge close to the other end of the swing arm 56. The other end of the tension spring 57 is connected to a frame of the sheet conveyor 30.

As the swing arm 56 swings about the swing center shaft 56*a* in a normal direction or a reverse direction due to on/off of the first solenoid actuator 58 (and the tension spring 57), the swing gear 52 meshes with one of the first and second relay gear trains 53A and 53B, thereby transmitting a driving force input by the second gear 50 via the first gear 51 to the drive gear 54.

The drive gear 54 is provided to a shaft of the sheet discharging drive roller 41, which is an end of the axis of the rotary center shaft 56*b*, and rotates with the sheet discharging drive roller 41 concurrently.

Namely, when the first solenoid actuator 58 is turned on or when a non-illustrated power supply applies a voltage, a biasing force exerted by the first solenoid actuator 58 causes the swing arm 56 to rotate about the swing center shaft 56*a* counterclockwise in FIG. 4A against a biasing force exerted by the tension spring 57. Consequently, the swing gear 52 meshes with the first relay gear train 53A, so that the driving force in a normal direction, which is a clockwise direction FIG. 4A, is transmitted to the drive gear 54. As a result, the sheet discharging drive roller 41 rotates in the normal direction, which is a direction of rotation thereof illustrated in FIGS. 2 and 3C.

By contrast, when the first solenoid actuator 58 is turned off or when the non-illustrated power supply stops voltage application, the biasing force exerted by the first solenoid actuator 58 is eliminated and the swing arm 56 rotates about the swing center shaft 56*a* clockwise in FIG. 4A due to the biasing force exerted by the tension spring 57. Consequently, the swing gear 52 meshes with the second relay gear train 53B, so that the driving force in a reverse direction, which is a counterclockwise direction in FIG. 4A, is transmitted to the drive gear 54. As a result, the sheet discharging drive roller 41 rotates in the reverse direction, which is a direction of rotation thereof illustrated in FIGS. 3A and 3B.

On the other hand, as illustrated in FIG. 4A, the second switchback mechanism 120 includes the first arm 61, the second arm 62, the tension spring 63, and so forth. One longitudinal end side of the first arm 61 and one longitudinal end side of the second arm 62 are connected to each other. A free end side, which is opposite to the one longitudinal end side, of the first arm 61 is connected to a guide connecting arm 46 of the branch guide claw 45. A free end side, which is opposite to the one longitudinal end side, of the second arm 62 is connected to the second solenoid actuator 64. The guide connecting arm 46 functions as a guide connector and is disposed extending from an end of the axis of the support shaft 45 of the branch guide claw 45 downward in FIG. 4 and rotates about the support shaft 45*a* together with the branch guide claw 45.

The first arm 61 has one end side to which the second solenoid actuator 64 is connected, a center portion to which one end of the tension spring 63 is connected and the other end side to which a shaft 62*a* is attached and one end side of the second arm 62 is rotatably connected. The other end of the tension spring 63 is connected to the frame of the sheet conveyor 30. The other end side of the second arm 62 is rotatably connected to a connecting shaft 46*a* that supports the guide connecting arm 46.

When the second solenoid actuator 64 is turned on or when a non-illustrated power supply applies a voltage, a biasing force exerted by the second solenoid actuator 64 causes the first arm 61 and the second arm 62 to move against a biasing force exerted by the tension spring 63. Consequently, the branch guide claw 45 rotates about the support shaft 45*a* together with the guide connecting arm 46 in the normal direction, which is the clockwise direction FIG. 4A. As a result, the branch guide claw 45 rotates in the normal direction within a given angle range to move to a given position thereof as illustrated in FIGS. 2 and 3C.

By contrast, when the second solenoid actuator 64 is turned off or when the non-illustrated power supply stops voltage application, the biasing force exerted by the second solenoid actuator 64 is eliminated and the first arm 61 and the second arm 62 move due to the biasing force exerted by the tension spring 63. Consequently, the branch guide claw 45 rotates about the support shaft 45*a* together with the guide connecting arm 46 in the reverse direction, which is the clockwise direction FIG. 4A. As a result, the branch guide claw 45 rotates in the reverse direction within a given angle range to move to another given position thereof as illustrated in FIGS. 3A and 3B.

The connecting shaft 46*a*, the shaft 62*a*, and a shaft to which the second solenoid actuator 64 is connected of the first arm 61 and the second arm 62 move along non-illustrated slots formed on the frame of the sheet conveyor 30 to make the first arm 61 and the second arm 62 movable.

The sheet conveyor 30 having the first arrangement in FIG. 4A has separate solenoid actuators, which are the first solenoid actuator 58 and the second solenoid actuator 64, to change the direction of rotation of the sheet discharging drive roller 41 and to change the path for the sheet S by changing the position of the branch guide claw 45 separately. Therefore, in the duplex printing mode previously described with reference to FIG. 3, even if multiple sheets S are sequentially conveyed, the switchback operation timings of the sheet discharging drive roller 41 and the branch guide claw 45 are not synchronized. Accordingly, the multiple sheets S can be fed serially at smaller intervals therebetween. As a result, the image forming apparatus 1 incorporating the sheet conveyor 30 having the first arrangement can meet the demands of users who set a higher value on high productivity than low cost.

By contrast, the sheet conveyor 30 having the second arrangement in FIG. 4B has the third switchback mechanism 130 to link the operation of changing the direction of rotation of the sheet discharging drive member 41 and the operation of changing the position of the branch guide claw 45 by using the first solenoid actuator 58 without the second solenoid actuator 64.

As previously described, the third switchback mechanism 130 includes the first gear 51, the swing gear 52, the first relay gear train 53A, the second relay gear train 53B, the driving gear 54, the swing arm 56, the tension spring 57, and the linking arm 66. That is, the third switchback mechanism 130 corresponds to a configuration in which the second switchback mechanism 120 and the second solenoid actuator 64 are removed and the linking arm 66 is added to the sheet conveyor 30 in the first arrangement.

Namely, as illustrated in FIG. 4B, the third switchback mechanism 130 includes the units and components included in the first switchback mechanism 110 in the first arrangement, except the linking arm 66. The linking arm 66 has one longitudinal end side that is connected to the connecting shaft 46*a* of the guide connecting arm 46 attached to the branch guide claw 45 and the other end side that is connected to the shaft 56*a* of the swing arm 56. As described above, the connecting shaft 46*a* of the guide connecting arm 46 is formed to rotatably connect the second arm 62 and the rotary center shaft 56*b* of the swing arm 56 is formed to connect the swing gear 52.

When the first solenoid actuator 58 is turned on or when the non-illustrated power supply applies a voltage, the biasing force exerted by the first solenoid actuator 58 causes the swing arm 56 to rotate about the swing center shaft 56*a* counterclockwise in FIG. 4B against the biasing force exerted by the tension spring 57. Consequently, the swing gear 52 meshes with the first relay gear train 53A, so that the driving force in the normal direction, which is a clockwise direction FIG. 4B, is transmitted to the drive gear 54. As a result, the sheet discharging drive roller 41 rotates in the normal direction, which is the direction of rotation thereof illustrated in FIGS. 2 and 3C. At the same time, the rotation of the swing arm 56 counterclockwise in FIG. 4B moves the linking arm 66 to the leftward, and the branch guide claw 45 rotates about the support shaft 45*a* together with the guide connecting arm 46 in the normal direction, which is the counterclockwise direction FIG. 4B. As a result, the branch guide claw 45 rotates in the normal direction within a given angle range to move to the given position thereof as illustrated in FIGS. 2 and 3C.

By contrast, when the first solenoid actuator 58 is turned off or when the non-illustrated power supply stops voltage application, the biasing force exerted by the first solenoid actuator 58 is eliminated and the swing arm 56 rotates about the swing center shaft 56*a* clockwise in FIG. 4B due to the biasing force exerted by the tension spring 57. Consequently, the swing gear 52 meshes with the second relay gear train 53B, so that the driving force in the reverse direction, which is the counterclockwise direction in FIG. 4B, is transmitted to the drive gear 54. As a result, the sheet discharging drive roller 41 rotates in the reverse direction, which is a direction of rotation thereof illustrated in FIGS. 3A and 3B. At the same time, the rotation of the swing arm 56 clockwise in FIG. 4B moves the linking arm 66 to the rightward, and the branch guide claw 45 rotates about the support shaft 45*a* together with the guide connecting arm 46 in the reverse direction. As a result, the branch guide claw 45 rotates in the reverse direction within a given angle range to move to the given position thereof as illustrated in FIGS. 3A and 3B.

The sheet conveyor 30 having the second arrangement in FIG. 4B has a single solenoid actuator, which is the first solenoid actuator 58, to link the switchback operation to change the direction of rotation of the sheet discharging drive roller 41 and the switchback operation to change the position of the branch guide claw 45. Therefore, in the duplex printing mode previously described with reference to FIG. 3, when multiple sheets S are sequentially conveyed, the switchback operation timings of the sheet discharging drive roller 41 and the branch guide claw 45 are to be synchronized. Consequently, the multiple sheets S may not be fed serially at smaller intervals therebetween. Namely, it is likely that the subsequent sheet S is fed after completion of either one of the switchback operation of the sheet discharging drive roller 41 and the switchback operation of the branch guide claw 45. As a result, the image forming apparatus 1 that incorporates the sheet conveyor 30 having the second arrangement can meet the demands of users who set a higher value on low cost than high productivity.

Further, in the sheet conveyor 30 according to the present embodiment, the second solenoid actuator 64 and the second switchback mechanism 120 (i.e., the first arm 61, the second arm 62, and the tension spring 63) are removed and the linking arm 66 is attached to change its configuration from the first arrangement to the second arrangement. By contrast, the linking arm 66 is removed and the second solenoid actuator 64 and the second switchback mechanism 120 are attached to change its configuration from the second arrangement to the first arrangement. With the sheet conveyor 30 that allows easy modification of arrangements in its configuration by using multiple common parts employed therein, development and production efficiencies can be significantly enhanced as a whole product family.

Specifically, the sheet conveyor 30 in the first arrangement as illustrated in FIG. 4A is modified to the second arrangement as follows.

The sheet conveyor 30 in the first arrangement originally includes the sheet discharging drive roller 41 that changes or switchbacks the direction of rotation of the sheet S, the branch guide claw 45 that rotates about the support shaft 45*a* to change the position for selecting the path for guiding the sheet S, the first switchback mechanism 110 that changes the direction of rotation of the sheet discharging drive roller 41, the first solenoid actuator 58 that actuates the first switchback mechanism 110, the second switchback mechanism 120 that changes the position of the branch guide claw 45, and the second solenoid actuator 64 that actuates the second switchback mechanism 120. By adding the linking arm 66, the third switchback mechanism 130 formed to link the switchback operation to change the direction of rotation of the sheet discharging drive roller 41 and the switchback operation to change the position of the branch guide claw 45 is actuated by either one actuator of the first solenoid actuator 58 and the second solenoid actuator 64 without changing the installation position without using the other actuator. In the present embodiment, the first solenoid actuator 58 is used to actuate the third switchback mechanism 130 while the second solenoid actuator 64 is not used.

More specifically, the first switchback mechanism 110 includes the swing arm 56, the one longitudinal end side of which is connected to the first solenoid actuator 58 is connected and the opposite end side of which is connected to the swing gear 52 that meshes with one of the first relay gear train 53A and the second relay gear train 53B to mesh with the drive gear 54 attached to the sheet discharging drive roller 41. The second switchback mechanism 120 includes the first arm 61 and the second arm 62, respective longitudinal end sides of which are connected to each other. The free end side of the first arm 61 is connected to the guide connecting arm 46 of the branch guide claw 45 and the free end side of the second arm 62 is connected to the second solenoid actuator 64. The guide connecting arm 46 has the connecting shaft 46*a* to which the first arm 61 and the second arm 62 are detachably attached can be connected to one longitudinal end side of the linking arm 66. The swing arm 56 has the rotary center shaft 56*a* to which the swing gear 52 is attached can be connected to the other end side of the linking arm 66.

To enable the above-described modification, the sheet conveyor 30 has sufficient space to install the linking arm 66 in the first arrangement of FIG. 4A.

By contrast, the sheet conveyor 30 in the second arrangement as illustrated in FIG. 4B is modified to the first arrangement as follows.

The sheet conveyor 30 in the second arrangement originally includes the sheet discharging drive roller 41 that changes or switchbacks the direction of rotation of the sheet S, the branch guide claw 45 that rotates about the support shaft 45*a* to change the position for selecting the path for guiding the sheet S, the third switchback mechanism 130 that links the switchback operation to change the direction of rotation of the sheet discharging drive roller 41 and the switchback operation to change the position of the branch guide claw 45, and the first solenoid actuator 58 that actuates the third switchback mechanism 130. By removing the linking arm 66, which is a component of the third switchback mechanism 130, the switchback operation to change the direction of rotation of the sheet discharging drive roller 41 and the switchback operation to change the position of the branch guide claw 45 are unlinked. The linking arm 66 is replaced with the second switchback mechanism 120 and the second solenoid actuator 64. Consequently, the first solenoid actuator 58 is used to actuate the first switchback mechanism 110 without changing the installation position thereof and the second solenoid actuator 64 is used to actuate the second switchback mechanism 120, separately.

More specifically, the third switchback mechanism 130 includes the swing arm 56, the one longitudinal end side of which is connected to the first solenoid actuator 58 is connected and the opposite end side of which is connected to the swing gear 52 that meshes with one of the first relay gear train 53A and the second relay gear train 53B to mesh with the drive gear 54 attached to the sheet discharging drive roller 41. The third switchback mechanism 130 further includes the linking arm 66. One longitudinal end side of the linking arm 66 is detachably connected to the guide connecting arm 46 attached to the branch guide claw 45 and the other end side thereof is detachably connected to the shaft 56*a* of the swing arm 56 with the swing gear 52 attached thereto. The guide connecting arm 46 to which the linking arm 66 is detachably connected at the connecting shaft 46*a* is connected to the free end side of the second arm 62 of the second switchback mechanism 120. The free end side of the first arm 61 of the second switchback mechanism 120 is connected to the second solenoid actuator 64.

To enable the above-described modification, the sheet conveyor 30 has sufficient space to install the first arm 61, the second arm 62, the tension spring 63, and the second solenoid actuator 64 in the second arrangement of FIG. 4B.

In the present embodiment, the third switchback mechanism 130 in the second arrangement can be configured to use the whole or a part of the second switchback mechanism 120 to act as the linking arm 66.

Specifically, a length of axis from the connecting shaft 46*a* to the shaft 62*a* of the second arm 62 is set to be equal to a length of axis from the connecting shaft 46*a* to the rotary center shaft 56*b* of the linking arm 66. By so doing, the second arm 62 of the second switchback mechanism 120 in the first arrangement can be replaced as the linking arm 66 of the third switchback mechanism 130 in the second arrangement. As a result, more parts or components can be used in common between the first arrangement and the second arrangement.

It is to be noted that, not being used as a component of the second switchback mechanism 120 in the second arrangement, the second arm 62 is defined as a different member that does not function as a component of the first switchback mechanism 110 and/or the second switchback mechanism 120.

In the present embodiment, the first and second switchback mechanisms 110 and 120, the first solenoid actuator 58, and the second solenoid actuator 64 in the first arrangement and the linking arm 66 in the second arrangement are disposed at either an inward portion or an outward portion in a lateral direction of the sheet conveyor 30 of the image forming apparatus 1 (a vertical direction to the drawing sheet of FIG. 1).

By contrast, the first and second switchback mechanisms 110 and 120, the first solenoid actuator 58, and the second solenoid actuator 64 in the first arrangement and the linking arm 66 in the second arrangement may be disposed separately at the inward portion and the outward portion in the lateral direction of the sheet conveyor of the image forming apparatus 1. For example, the first switchback mechanism 110 and the first solenoid actuator 58 may be disposed at the inward (or outward) portion and the second switchback mechanism 120 and the second solenoid actuator 64 may be disposed at the outward (or inward) portion. By so doing, the limitation in design with respect to the installation positions and respective ranges of movement of the first and second mechanisms can be reduced.

The present embodiment is applicable to the sheet conveyor 30 in which the sheet discharging drive roller 41 is disposed in contact with two rollers, which are the first and second sheet discharging driven rollers 42 and 43, to form respective nip areas to hold and convey the sheet S.

Figure 5:
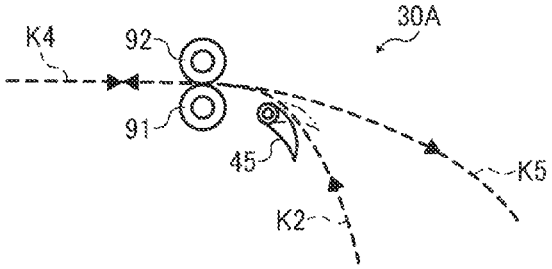
FIG. 5 is a diagram illustrating a switchback mechanism of a sheet conveyor according to another embodiment.

By contrast, FIG. 5 illustrates a configuration of a sheet conveyor 30A according to another embodiment. In this embodiment, a sheet discharging drive roller 91 that functions as a sheet conveying roller is disposed in contact with one roller, which is a sheet discharging driven roller 92, to form a nip area to hold and convey the sheet S, as illustrated in FIG. 5. This configuration can also achieve the same effectiveness as the configuration of the sheet conveyor 30.

In the sheet conveyor 30A in FIG. 5, when the sheet S is discharged to the stacker 100, the branch guide claw 45 rotates to the given position to open the second path K2 and the sheet discharging drive roller 91 rotates counterclockwise in FIG. 5 to allow the sheet S to pass through the fourth path K4 to be discharged to the stacker 100.

By contrast, when the duplex printing mode is selected, a portion in the vicinity of the trailing edge TE of the sheet S is held between the sheet discharging drive roller 91 and the sheet discharging driven roller 92, then the sheet discharging drive roller 91 rotates in reverse, which is in the clockwise direction in FIG. 5. At the same time, the branch guide claw 45 rotates to the given position to close the second path K2 and open the fifth path K5 functioning as a duplex printing conveyance path, so that the sheet S can be guided to the fifth path K5.

As described above, the sheet conveyors 30 and 30A can provide a configuration that can select one of the first arrangement having two separate actuators (the first switchback mechanism 110 in which the direction of rotation of the sheet discharging drive roller 41 is changed is actuated by the first solenoid actuator 58 and the second switchback mechanism 120 in which the position of the branch guide claw 45 is changed is actuated by the second solenoid actuator 64) and the second arrangement having one actuator (the third switchback mechanism 130 in which the direction of rotation of the sheet discharging drive roller 41 as well as the position of the branch guide claw 45 are changed is actuated by the first solenoid actuator 58 by adding the linking arm 66, which is not included in the first switchback mechanism 110 and the second switchback mechanism 120). With this configuration, the sheet conveyor 30 (30A) including the separate solenoid actuators 58 and 64 to actuate the first and second switchback mechanisms 110 and 120, respectively, and the sheet conveyor 30 (30A) including the solenoid actuator 58 to actuate the third switchback mechanism 130 to link the operation of changing the direction of rotation of the sheet discharging drive roller 41 and of changing the position of the branch guide claw 45 may be developed and manufactured efficiently.

In the above-described embodiments, the sheet conveyor 30 or the sheet conveyor 30A is incorporated in the image forming apparatus 1 for producing and printing color images, but is not limited thereto and also applicable to an image forming apparatus for producing and printing monochrome images.

Further, in the above-described embodiments, the sheet conveyor 30 or the sheet conveyor 30A is disposed in the vicinity of the stacker 100, but is not limited thereto and may be disposed any other positions in the image forming apparatus 1 or any other image forming apparatuses.

Further, in the above-described embodiments, the sheet conveyor 30 or the sheet conveyor 30A is incorporated in the electrophotographic image forming apparatus 1, but is not limited thereto and can be incorporated in any other image forming apparatus such as an inkjet-type image forming apparatus.

These sheet conveyors and image forming apparatuses can also achieve the same effectiveness as the sheet conveyor 30 according to the above-described embodiments.

Further, in the above-described embodiments, the second solenoid actuator 64 is removed while the first solenoid actuator 58 remained in the second arrangement of the sheet conveyor 30 (30A). However, the first solenoid actuator 58 may be removed while the second solenoid actuator 64 remained in the second arrangement of the sheet conveyor 30 (30A).

Further, the configurations of the first, second, and third switchback mechanisms 110, 120, and 130 are not limited as described in the above-described embodiments but can be different types of configurations.

Further, the first solenoid actuator 58 and the second solenoid actuator 64 are used in the above-described embodiments, but actuators that function as drive sources of switchback operations are not limited thereto. For example, a cam mechanism using a motor is also applicable to the present invention.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet conveyor comprising:

a conveying roller rotatable in normal and reverse directions to convey a sheet of recording material in opposite sheet conveyance directions;

a support shaft;

a switching guide rotatable about the support shaft to guide the sheet to a selected conveyance path;

a first switchback mechanism configured to perform a first operation of changing a direction of rotation of the conveying roller;

a first actuator to actuate the first switchback mechanism to perform the first operation;

a second switchback mechanism configured to perform a second operation of changing a position of the switching guide;

a second actuator to actuate the second switchback mechanism to perform the second operation, wherein the first switchback mechanism and the second switchback mechanism are configured to be replaceable with a switchback linking mechanism by employing a linking member, and the switchback linking mechanism is configured to link the first operation and the second operation and to be actuated by one actuator of the first actuator and the second actuator without changing an arrangement of the one actuator of the first actuator and the second actuator, a guide connector connected to the switching guide at one end side thereof supported by the support shaft;

a connecting shaft to support the guide connector at an opposite end side of the guide connector; and a rotary center shaft, wherein the first switchback mechanism comprises a drive gear meshed with the conveying roller;

two relay gear trains meshed with the drive gear;

a swing gear selectively meshed with either one of the relay gear trains; and a swing arm supported by the rotary center shaft and having one end side connected to the first actuator and the other end side connected to the swing gear via the rotary center shaft, wherein the second switchback mechanism comprises a pair of transmission members having one end side connected to the second actuator and an opposite end side detachably connected to the opposite end side of the guide connector of the switching guide via the connecting shaft, wherein the guide connector is designed to connect to one end side of the linking member via the connecting shaft, and wherein the swing arm is designed to connect to the opposite end side of the linking member via the rotary center shaft to which the swing gear is attached.

2. The sheet conveyor according to claim 1, wherein the switchback linking mechanism is configured to be formed by removal of a given part of the first switchback mechanism and the second switchback mechanism and adding the linking member, wherein the one actuator is connected to the switchback linking mechanism while the other actuator remains unconnected thereto.

3. The sheet conveyor according to claim 2, wherein the linking member has the one end side connected to the guide connector via the connecting shaft to which the pair of transmission members is detachably connected and the opposite end side connected to the swing arm via the rotary center shaft to which the swing gear is attached, wherein the switchback linking mechanism is configured to be formed by removal of the pair of transmission members of the second switchback mechanism and addition of the linking member.

4. The sheet conveyor according to claim 3, wherein the switchback linking mechanism is configured to be formed by removal of the pair of transmission members of the second switchback mechanism and by addition of at least one member of the pair of transmission members.

5. An image forming apparatus comprising:

an image forming device; and the sheet conveyor according to claim 1.

6. The image forming apparatus according to claim 5, wherein the switchback linking mechanism is configured to be formed by removal of a given part of the first switchback mechanism and the second switchback mechanism and adding the linking member, wherein the one actuator is connected to the switchback linking mechanism while the other actuator remains unconnected thereto.

7. The image forming apparatus according to claim 6, wherein the linking member has the one end side connected to the guide connector via the connecting shaft to which the pair of transmission members is detachably connected and the opposite end side connected to the swing arm via the rotary center shaft to which the swing gear is attached, wherein the switchback linking mechanism is configured to be formed by removal of the pair of transmission members of the second switchback mechanism and addition of the linking member.

8. The image forming apparatus according to claim 7, wherein the switchback linking mechanism is configured to be formed by removal of the pair of transmission members of the second switchback mechanism and by addition of at least one member of the pair of transmission members.

9. A sheet conveyor, comprising:

a conveying roller rotatable in normal and reverse directions to convey a sheet of recording material in opposite sheet conveyance directions;

a support shaft;

a switching guide rotatable about the support shaft to guide the sheet to a selected conveyance path;

a switchback linking mechanism including a linking member and configured to link a first operation of changing a direction of rotation of the conveying roller and a second operation of changing a position of the switching guide; and a first actuator to actuate the switchback linking mechanism to perform the first operation and the second operation by linking to each other, wherein the linking member is configured to be removable from the switchback linking mechanism to replace the switchback linking mechanism with a first switchback mechanism to perform the first operation of changing a direction of rotation of the conveying roller and the second switchback mechanism to perform a second operation of changing a position of the switching guide to cause the first operation and the second operation to be performed separately;

a second actuator, wherein the first switchback mechanism is actuated by the first actuator and the second switchback mechanism is actuated by the second actuator;

a guide connector connected to the switching guide at one end side thereof supported by the support shaft;

a connecting shaft to support the guide connector at an opposite end side of the guide connector; and a rotary center shaft, wherein the switchback linking mechanism further comprises a drive gear meshed with the conveying roller;

two relay gear trains meshed with the drive gear;

a swing gear selectively meshed with either one of the relay gear trains; and a swing arm supported by the rotary center shaft and having one end side connected to the first actuator and the other end side connected to the swing gear via the rotary center shaft, wherein the linking member has one end side detachably connected to the guide connector via the connecting shaft and an opposite end side detachably connected to the swing arm via the rotary center shaft to which the swing gear is attached, wherein the second switchback mechanism comprises a pair of transmission members having one end side connected to the second actuator, wherein the guide connector is designed to connect to the opposite end side of the pair of transmission members via the connecting shaft to which the linking member is detachably connected.

10. The sheet conveyor according to claim 9, wherein the switchback linking mechanism is configured to be formed by removal of a given part of the first switchback mechanism and the second switchback mechanism and adding the linking member, wherein the one actuator is connected to the switchback linking mechanism while the other actuator remains unconnected thereto.

11. The sheet conveyor according to claim 10, wherein the linking member has the one end side connected to the guide connector via the connecting shaft to which the pair of transmission members is detachably connected and the opposite end side connected to the swing arm via the rotary center shaft to which the swing gear is attached, wherein the switchback linking mechanism is configured to be formed by removal of the pair of transmission members of the second switchback mechanism and addition of the linking member.

12. The sheet conveyor according to claim 11, wherein the switchback linking mechanism is configured to be formed by removal of the pair of transmission members of the second switchback mechanism and by addition of at least one member of the pair of transmission members.

13. An image forming apparatus comprising:

an image forming device; and the sheet conveyor according to claim 9.

14. The image forming apparatus according to claim 13, wherein the switchback linking mechanism is configured to be formed by removal of a given part of the first switchback mechanism and the second switchback mechanism and addition of the linking member, wherein the one actuator is connected to the switchback linking mechanism while the other actuator remains unconnected thereto.

15. The image forming apparatus according to claim 14, wherein the linking member has the one end side connected to the guide connector via the connecting shaft to which the pair of transmission members is detachably connected and the opposite end side connected to the swing arm via the rotary center shaft to which the swing gear is attached, wherein the switchback linking mechanism is configured to be formed by removal of the pair of transmission members of the second switchback mechanism and addition of the linking member.

16. The image forming apparatus according to claim 15, wherein the switchback linking mechanism is configured to be formed by removal of the pair of transmission members of the second switchback mechanism and by addition of at least one member of the pair of transmission members.

17. An image forming apparatus comprising:

a sheet conveyor, wherein the sheet conveyer comprises, a support shaft;

a switching guide rotatable about the support shaft;

a first switchback mechanism;

a first actuator configured to actuate the first switchback mechanism;

a second switchback mechanism configured to change a position of the switching guide;

a second actuator configured to actuate the second switchback mechanism;

a guide connector connected to the switching guide at one end side thereof supported by the support shaft;

a connecting shaft to support the guide connector at an opposite end side of the guide connector; and a rotary center shaft, wherein the first switchback mechanism comprises a drive gear meshed with the conveying roller;

two relay gear trains meshed with the drive gear;

a swing gear selectively meshed with either one of the relay gear trains; and a swing arm supported by the rotary center shaft and having one end side connected to the first actuator and the other end side connected to the swing gear via the rotary center shaft, wherein the second switchback mechanism comprises a pair of transmission members having one end side connected to the second actuator and an opposite end side detachably connected to the opposite end side of the guide connector of the switching guide via the connecting shaft, wherein the guide connector is connected to one end side of the linking member via the connecting shaft, wherein the swing arm is connected to the opposite end side of the linking member via the rotary center shaft to which the swing gear is attached.

* * * * *